US006874431B1

(12) United States Patent
Danna

(10) Patent No.: US 6,874,431 B1
(45) Date of Patent: Apr. 5, 2005

(54) COMPUTER DESK WITH SLIDABLY EXTENDIBLE DESKTOP

(76) Inventor: Matthew G. Danna, 3536 E. Medlock Dr., Phoenix, AZ (US) 85018

( * ) Notice: Subject to any disclaimer, the term of this patent is extended or adjusted under 35 U.S.C. 154(b) by 0 days.

(21) Appl. No.: 10/655,133

(22) Filed: Sep. 5, 2003

(51) Int. Cl.[7] ..... A47B 11/00

(52) U.S. Cl. ..... 108/143; 108/102; 108/50.02; 108/50.01; 312/223.1

(58) Field of Search ..... 108/50.01, 50.02, 108/102, 143; 248/918; 312/223.3, 208.1

(56) References Cited

U.S. PATENT DOCUMENTS 5,287,815 A 2/1994 Gross
5,437,235 A 8/1995 Randolph
5,490,466 A 2/1996 Diffrient
5,623,881 A * 4/1997 Huang ..... 108/50.01
5,909,934 A * 6/1999 McGraw ..... 312/223.3
5,967,631 A 10/1999 Ko
6,076,473 A * 6/2000 Conte ..... 108/50.01
6,135,032 A 10/2000 Ko
6,269,753 B1 * 8/2001 Roddan ..... 108/50.01
6,382,745 B1 * 5/2002 Adkins ..... 312/223.3
6,398,326 B1 * 6/2002 Wang ..... 312/223.3
6,439,657 B1 * 8/2002 Tholkes ..... 297/172
6,446,564 B1 9/2002 Anderson
6,474,760 B2 * 11/2002 Rauls ..... 312/330.1

FOREIGN PATENT DOCUMENTS

DE 42 00 965 7/1992

* cited by examiner

*Primary Examiner*—Peter M. Cuomo
*Assistant Examiner*—Erika Garrett
(74) *Attorney, Agent, or Firm*—Richard C. Litman

(57) ABSTRACT

A desk for use with a computer and keyboard, wherein the desk has a slidably extendible desktop, which slides towards the user when pulled. The desk has a U-shaped base and a U-shaped desk frame connected by two vertical posts so that the desk frame extends above the base. A slider mechanism including a guide and runners or rollers is attached between the desktop and the U-shaped desk frame so that the entire desktop is slidable between a retracted position above the base and an extended position. Thus the user can sit in an armchair, recliner or other comfortable chair and pull the entire desktop towards the chair in order to work on the computer. The computer desk includes a keyboard tray mounted on a slide so that the keyboard can be retracted under the desktop when not in use.

3 Claims, 6 Drawing Sheets

COMPUTER DESK WITH SLIDABLY EXTENDIBLE DESKTOP

BACKGROUND OF THE INVENTION

1. Field of the Invention

The present invention relates to computer desks, and particularly to a computer desk with a slidable desktop, which may be pulled out towards the user's chair to create a more comfortable working environment.

2. Description of Related Art

The advent of the computer has in large part lead to a reevaluation in the design of work desks. Where a desk was once designed to provide a simple work surface, it may now come with various features such as adjustable tabletops, keyboard shelves, built-in armrests and the like. Ergonomics have also become a central consideration in designing furniture for people who spend a significant amount of time at their desks. More comfortable chairs and desks are now a necessity as people increasingly suffer from back pain, carpal tunnel syndrome and other maladies associated with long periods in front of the computer. As a result, computer desks that offer more comfort and functionality have been developed.

U.S. Pat. No. 5,287,815, issued on Feb. 22, 1994 to Gross, describes a computer workstation having a keyboard shelf and an armrest attached to the keyboard shelf. A terminal may be located on a table behind the keyboard shelf. A belt supports the far end of the workstation table, while the front edge of the table contains a transverse pivot rod. A screw feed mechanism lengthens and shortens the belt, causing the table to rotate about the axis of the rod, thereby adjusting the inclination of the table.

U.S. Pat. No. 5,437,235, issued Aug. 1, 1995 to Randolph, describes a computer workstation having a stationary work surface with an enlarged monitor opening therein, a recessed component support pan attached to the work surface under the monitor opening, and a raisable monitor support mechanism mounted in the component pan that supports the monitor platform. The monitor lift mechanism is an extendable folding frame with a spring mechanism to counterbalance the weight of the monitor. An adjustable work surface is mounted at the front of the work surface on cantilever arms extending out of the pan.

U.S. Pat. No. 5,490,466, issued Feb. 13, 1996 to Diffrient, describes a tabletop having a vertically adjustable keyboard support platform suspended on a parallel linkage assembly. The parallel linkage rotates about a pair of rotatable pivot rods on the underside of the platform. When the platform is in the desired lowered position, a gas spring connected to the linkage blocks its rotation. The spring mechanism also aids in returning the platform to a position flush with the tabletop.

U.S. Pat. No. 5,967,631, issued Oct. 19, 1999 to Ko, describes a computer desk composed of a desk top, a reference slide, an article tray, a stationary rack, a drawer, two legs, two leg-supporting bases, a cross rod, and a connection rod. The desktop and attached components are supported by three sets of support frames. The legs are supported by leg-supporting bases, as well as the connection rod and cross rod. Two desks may be connected side by side with a curved tube and support board.

U.S. Pat. No. 6,135,032, issued Oct. 24, 2000 to Ko, describes a computer desk having ascendible and descendible desktops. The computer desk has a main desktop and an auxiliary desktop, both of which are ascendible and descendible. The main desktop and the auxiliary desktop are mounted on the top ends of movable support rods, which can be raised or lowered by turning the adjustment knob clockwise or counterclockwise.

U.S. Pat. No. 6,446,564, issued Sep. 10, 2002 to Anderson, describes a desk with a sliding top section and keyboard tray. The desk features a retracting lid section conforming to a lid opening in the front edge of the desktop. The lid retraction mechanism consists of the lid being pivotally attached to linear drawer sliders mounted at a rearward sloping angle below the desktop. The lid is retracted by tilting up the front edge and sliding back the lid. This exposes an extendible keyboard tray.

German Patent No. 4,200,965, published on Jul. 23, 1992, describes a dual-purpose workstation having a carrier plate which may be raised and lowered through a coverable recess. A belt drive is used to raise and lower the plate, which may support a computer or other device. When the plate is fully raised, it is level with the surrounding desktop surface.

None of the above inventions and patents, taken either singly or in combination, is seen to describe the instant invention as claimed.

SUMMARY OF THE INVENTION

The present invention is a computer desk having an extendible and retractable desktop for use with any type of chair, including armchairs, recliners ottomans, etc. Once seated in front of the desk, the user can pull the desktop towards him/herself without having to move the chair. The design thus allows the user to sit at variable distances from the desk without changing position. This creates a more comfortable work environment for the user, who can relax in his/her chair and pull out the desk to a suitable position in front. The desktop slides out in the same manner as a desk drawer when the user pulls it forward. The desktop is also equipped with a keyboard tray mounted beneath the desktop, which extends out towards the user. The desktop may have any desired size and shape. The computer desk of the present invention does not require any specially made components and is easily assembled.

Accordingly, it is a principal object of the invention to provide a computer desk with a slidably extendible desktop that may be pulled forward to a comfortable position in front of the user.

It is another object of the invention to provide a computer desk that accommodates chairs of different shapes and sizes, such as armchairs, recliners, and ottomans, and allows the user to adjust the position of the desktop to a desired position based on the user's position in the chair, as opposed to changing the position of the chair.

It is another object of the invention to provide a computer desk that features a keyboard tray that extends out towards the user from a storage bay beneath the desktop.

Still another object of the invention is to provide a computer desk with slidably extendible desktop having a support structure of ample strength to support heavy items on the desk surface, in both its retracted and fully extended positions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
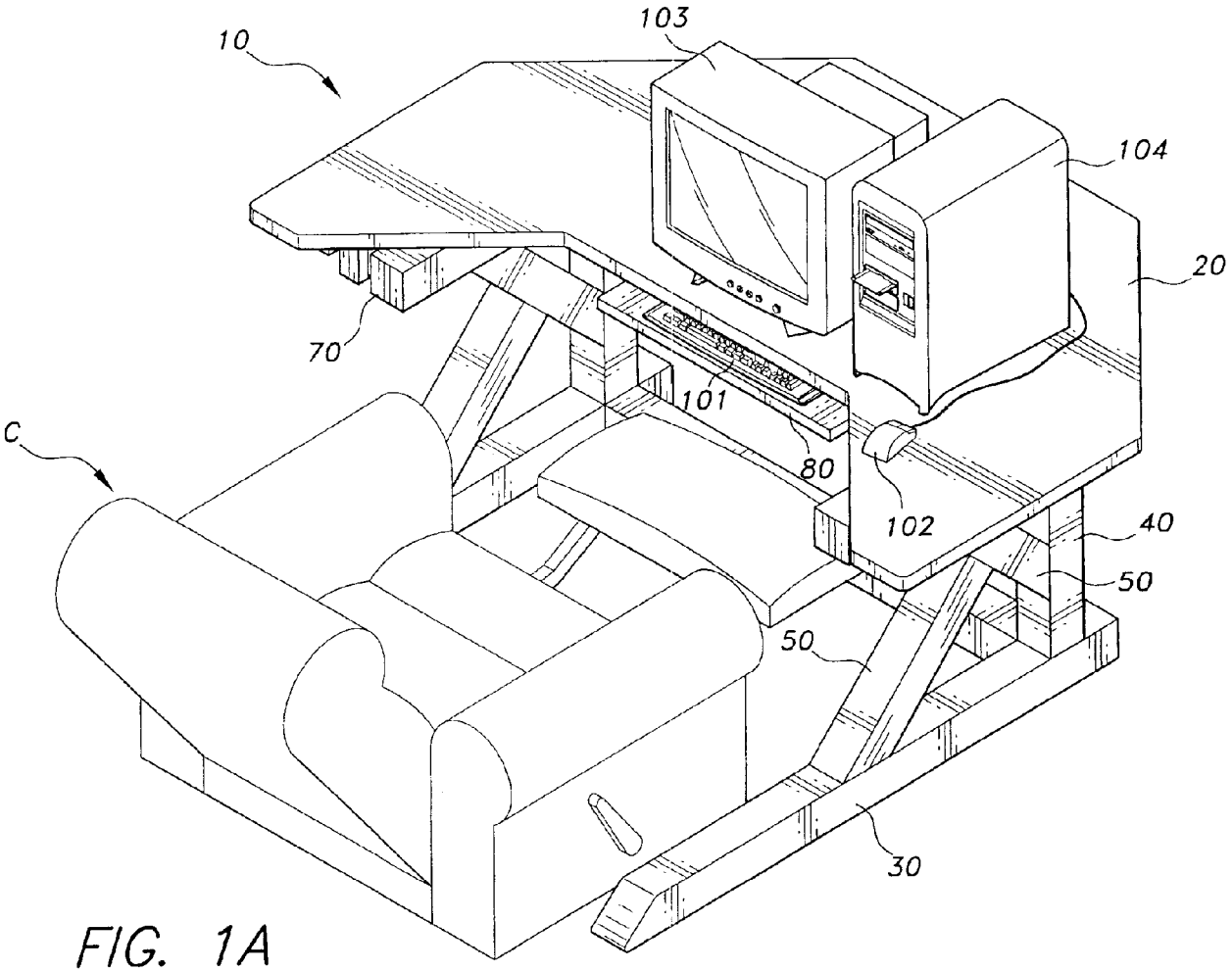
FIG. 1A is an environmental, perspective view of a computer desk according to the present invention.

The present invention is a computer desk, designated generally as 10 in the drawings. The computer desk 10 features a desktop 20 that slides forward like a drawer when pulled by the user. The computer desk 10 is shown in FIG. 1 as used with a recliner C, but is designed to accommodate any type of chair, including armchairs, recliners and ottomans, by eliminating the need to move the chair closer to the desk to achieve a comfortable work position. Rather, the desktop 20 can be moved to a comfortable position in front of the user without having to move the chair.

Figure 1B:
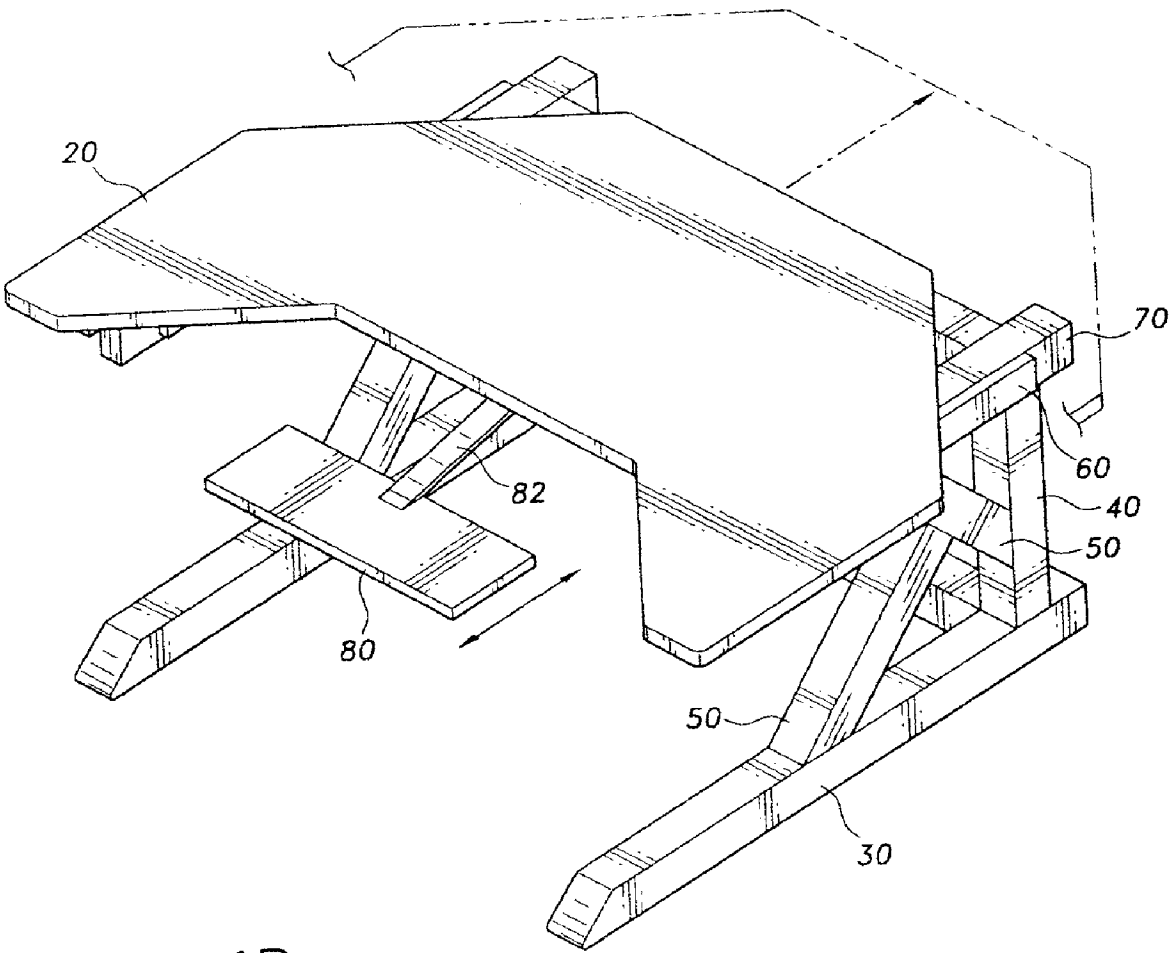
FIG. 1B is a perspective view of a computer desk according to the present invention showing the desktop and keyboard tray in an extended position.
Figure 2:
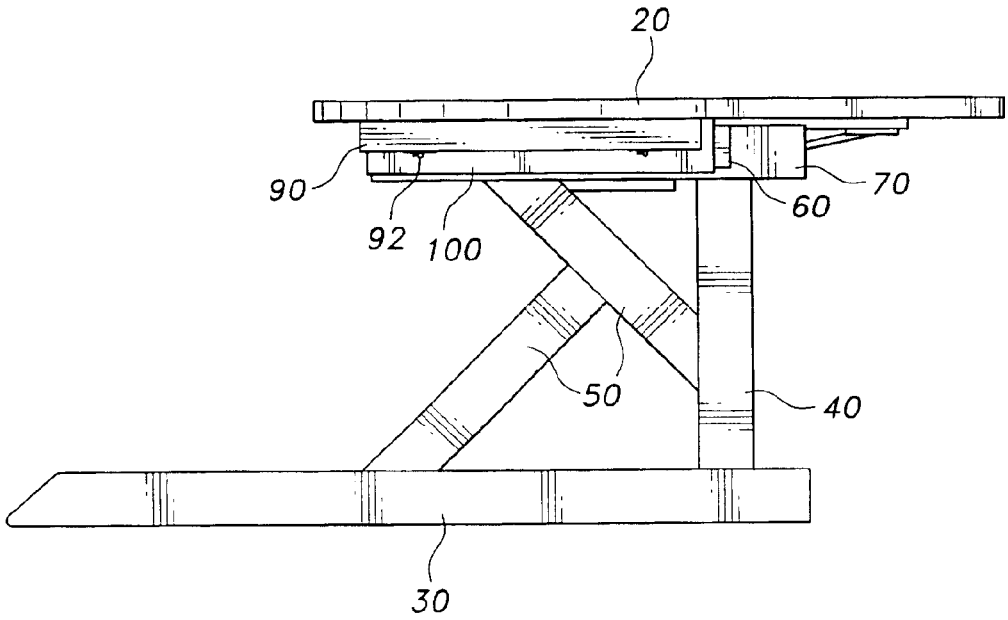
FIG. 2 is a side view of a computer desk according to the present invention.
Figure 3:
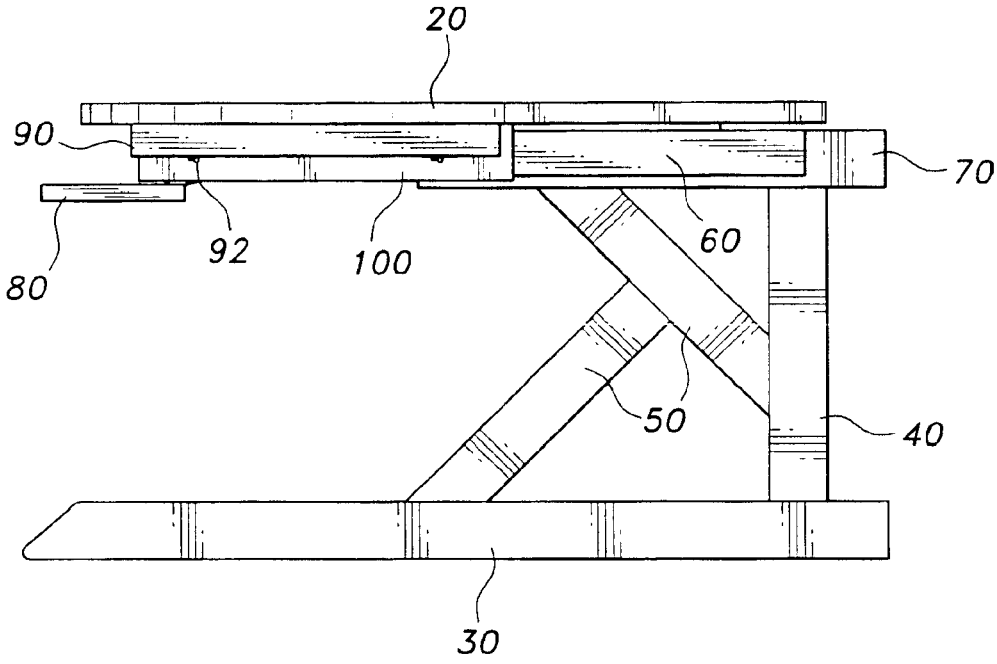
FIG. 3 is a side view of a computer desk according to the present invention showing the desktop and keyboard tray in an extended position.

Referring to FIGS. 1A and 1B, the computer desk 10 includes a slidably extendible desktop 20. An extendible keyboard tray 80, mounted underneath the desktop 20, also may be pulled out towards the user. The keyboard tray 80 is attached to a connecting arm 82 that slides along a keyboard tray track 110 (shown in FIGS. 4–5) when extended or retracted. Keyboard 101, mouse 102, computer monitor 103, and computer tower 104, (which do not form a part of the invention), are shown mounted on keyboard tray 80 and desktop 20 in FIG. 1A to illustrate the general purpose to which the invention is directed.

Referring to FIGS. 1A–3, the computer desk 10 is supported by a U-shaped base 30 having two legs extending from opposite ends of a cross-member. The legs are at least as long as the lengthwise distance covered by the fully extended desktop, and provide ample support for the extended desktop. Two vertical posts 40 are mounted on the U-shaped base 30 adjacent the junction of the two legs with the cross-member. A U-shaped desk frame 70 having two arms extending from opposite ends of a cross-beam supports the desktop 20, as shown in FIGS. 2–5. The U-shaped desk frame 70 is mounted on top of the vertical posts 40, the opposing ends of the arms of the U-shaped desk frame 70 being supported by diagonal braces 50. The diagonal braces are configured in a generally T-shaped configuration, and are attached to the arms of the U-shaped frame, the legs of the U-shaped base 30, and the vertical posts 40, respectively. The braces, however, are not limited to the T-configuration and may assume other configurations in different embodiments.

Figure 4:
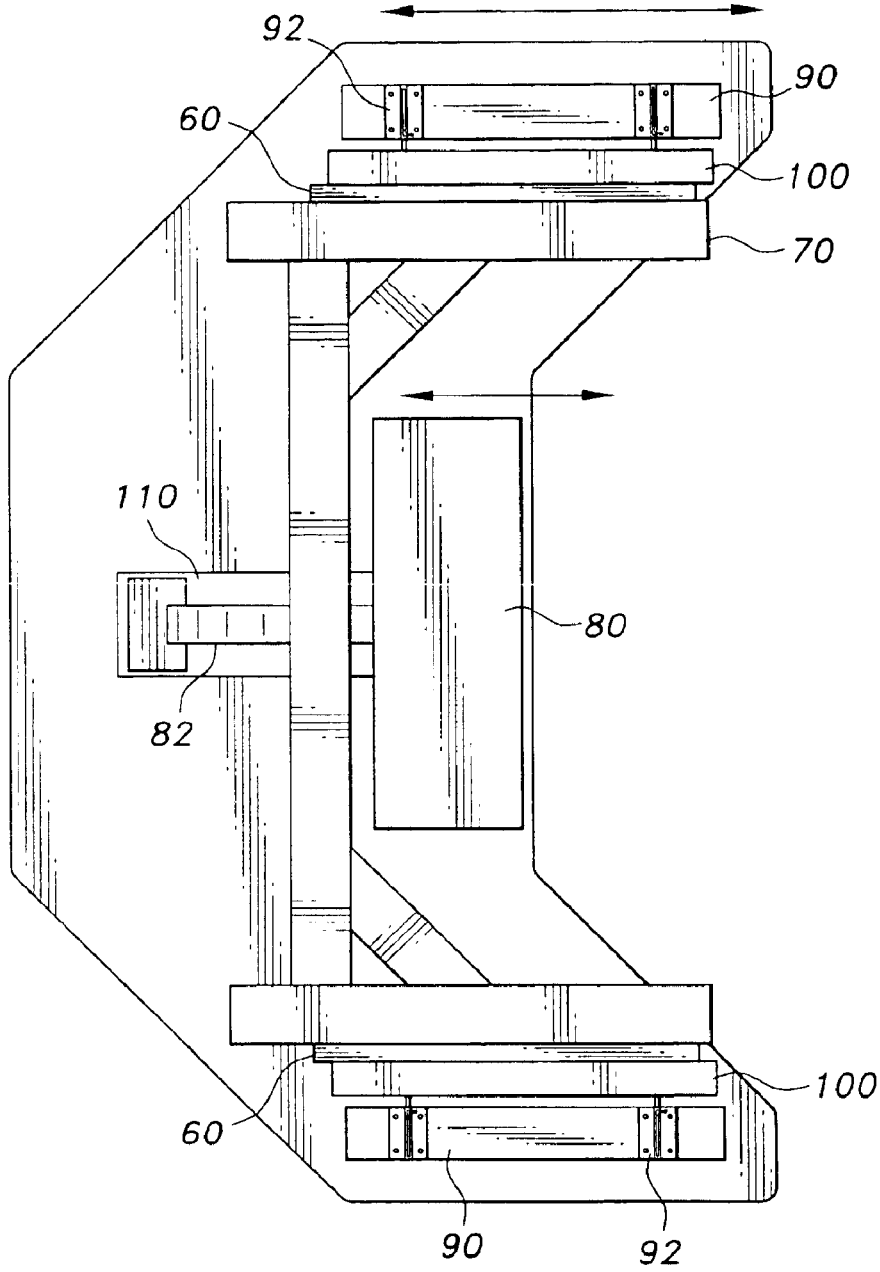
FIG. 4 is a bottom view of the computer desk according to the present invention showing the desk frame, keyboard tray and slidable desktop assembly.
Figure 5:
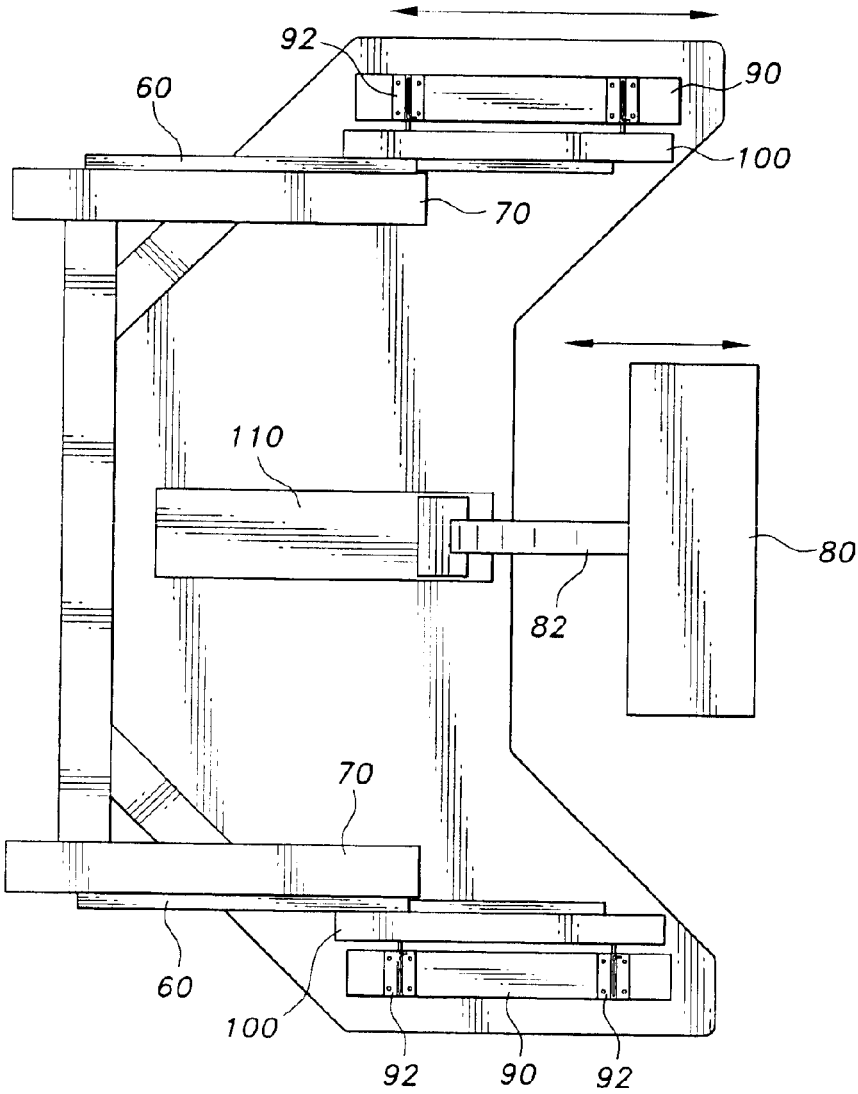
FIG. 5 is a bottom view of the computer desk according to the present invention showing the desktop and keyboard tray in an extended position.

Referring to FIGS. 4 and 5, bottom views show the computer desk 10 with the desktop 20 in its retracted (FIG. 4) and its extended (FIG. 5) positions. The desk frame 70 has a drawer slide with guide 60 attached to the outer surface of the left and right arms of the U-shaped desk frame 70. The drawer slide with guide 60 operatively engages with a side runner or rollers attached to a beam or 2×4 member 100, which runs parallel to each arm of the frame 70. The beam member 100 is attached to a rail 90 by way of a securing means, such as a bolt-action door lock 92. The rail 90 is connected to the underside of the desktop 20, which secures the desktop 20 as it slides across the desk frame 70. The interaction between the drawer slide 60 and slide runner 100 allows the desktop 20 to slide like a drawer when pulled towards the user.

In use, when desktop 20 is extended towards the user, as shown in FIG. 1B, the desktop rests on the left and right arms of the desk frame 70. The vertical posts 40 and support braces 50 are configured to provide adequate weight bearing capacity for loads placed on the front portion of the extended desktop 20. When the user requires access to the keyboard tray 80, the user pulls the keyboard tray 80 out from a storage area underneath the desktop 20. The keyboard tray 80 is connected to a connecting arm 82, the opposite end of which slides along a keyboard tray track 110 on rails, so as to move with the tray 80, as shown in FIGS. 4 and 5. The desk 10 thus offers use of the keyboard 101 from a sitting position close into the desk 10, and from a position further away from the desk 10, with the desktop 20 extended.

When the user wishes to pull out the desktop 20, the user pulls the desktop 20 towards him/herself. The desktop 20 moves smoothly until drawer slides 60 reach full extension. The desk 10 preferably uses a rail type drawer slide assembly 60 for the drawer guide. Alternatively, ball bearing drawer slides may be used to provide smooth and free movement. More economical alternatives are also available in the form of wood or plastic groove type drawer slide assemblies, which are sometimes used as drawer guides. Different sized and shaped desktops 20 may also be interchangeably used with the invention. The desktop configuration shown in the attached figures is suitable for use in corners, but other shapes may be more appropriate for different environments. In addition, the desk may be constructed from different materials such as, wood, metal, plastic, glass or any combination thereof.

It is to be understood that the present invention is not limited to the sole embodiment(s) described above, but encompasses any and all embodiments within the scope of the following claims.

I claim:

1. A computer desk, comprising:

(a) a cross-member and a pair of legs extending from opposite ends of the cross-member, defining a U-shaped base;

(b) a pair of vertical support posts extending from the legs adjacent the cross-member, the legs being normal to a plane defined by the U-shaped base;

(c) cross-beam and a pair of arms extending from opposite ends of the cross-beam, defining a desk frame, the arms being mounted on top of the vertical post adjacent the cross-beam, so that the arms of the desk frame extend substantially parallel to and above the legs of the base;

(d) a desktop having a top surface and a bottom surface, and a pair of parallel rails disposed on the bottom surface, the top surface being adapted for supporting computer equipment;

(e) a sliding track assembly disposed between the rails and the arms of the desk frame, whereby the desktop is slidable between a retracted position and an extended position in order to draw the entire desktop towards a user's chair;

(f) a keyboard tray track attached to the bottom surface of said desktop;

(g) a connecting arm slidable on the keyboard tray track; and (h) a keyboard tray attached to the connecting arm;

wherein the keyboard tray is slidably between a retracted position disposed beneath said desktop, and an extended position in front of said desktop.

2. The computer desk according to claim 1, farther comprising two pairs of diagonal braces, one of the two pairs being disposed on opposite sides of the base, respectively, each brace pair having a T-configuration and being attached to an arm, a leg, and a vertical post in order to rigidly support the arms.

3. A computer desk, comprising:

(a) a cross-member and a pair of legs extending from opposite ends of the cross-member, defining a U-shaped base;

(b) a pair of vertical support posts extending from the legs adjacent the cross-member, the legs being normal to a plane defined by the U-shaped base;

(c) cross-beam and a pair of arms extending from opposite ends of the cross-beam, defining a desk frame, the arms being mounted on top of the vertical post adjacent the cross-beam, so that the arms of the desk frame extend substantially parallel to and above the legs of the base;

(d) a desktop having a top surface and a bottom surface, and a pair of parallel rails disposed on the bottom surface, the top surface being adapted for supporting computer equipment;

(e) a sliding track assembly disposed between the rails and the arms of the desk frame, whereby the desktop is slidable between a retracted position and an extended position in order to draw the entire desktop towards a user's chair; and (f) two pairs of diagonal braces, one of the two pairs being disposed on opposite sides of the base, respectively, each brace pair having a T-configuration and being attached to an arm, a leg, and a vertical post in order to rigidly support the arms.

* * * * *